US005501460A

United States Patent [19]

Scheie

[11] Patent Number: 5,501,460

[45] Date of Patent: Mar. 26, 1996

[54] GOLF CLUB SET WITH CONSTANT PROJECTED TOPLINE ANGLE

[75] Inventor: Carl E. Scheie, Libertyville, Ill.

[73] Assignee: Wilson Sporting Goods Co., Chicago, Ill.

[21] Appl. No.: 310,876

[22] Filed: Sep. 23, 1994

[51] Int. Cl.[6] ..... A63B 53/04

[52] U.S. Cl. ..... 273/167 R; 273/77 A

[58] Field of Search ..... 273/77 R, 167 R, 273/167 J, 77 A

[56] References Cited

U.S. PATENT DOCUMENTS

| | | |
|---|---|---|
| 1,642,462 | 9/1927 | Reach . |
| 1,927,083 | 9/1933 | Davis . |
| 4,147,379 | 4/1979 | Jeghers . |
| 4,900,028 | 2/1990 | Antonious . |
| 4,971,321 | 11/1990 | Davis . |
| 5,160,137 | 11/1992 | Katayama . |
| 5,228,688 | 7/1993 | Davis . |
| 5,295,686 | 3/1994 | Lundberg . |

*Primary Examiner*—William M. Pierce

*Attorney, Agent, or Firm*—Tilton, Fallon, Lungmus, Chestnut

[57] ABSTRACT

A set of golf clubs has a constant projected topline angle, which is the angle between the topline and the leading edge of a clubhead as viewed by a golfer at address. The loft angle and the topline angle varies for each club in the set, but the projected topline angle is constant throughout the set.

5 Claims, 3 Drawing Sheets

GOLF CLUB SET WITH CONSTANT PROJECTED TOPLINE ANGLE

BACKGROUND

This invention relates to a set of golf clubs, and, more particularly, to a set of golf clubs in which each club has substantially the same projected topline angle.

A conventional iron-type golf club includes a shaft and a clubhead. The clubhead includes a sole, a toe, a heel, and a topline. The loft of the club is defined by the angle between the plane of the face and a plane which extends through the centerline of the shaft and parallel to the leading edge of the clubhead. The topline angle is the angle between the top line of the clubhead and the ground plane which is tangent to the center of the sole. In most conventional sets of clubheads, the topline angle is substantially constant throughout the set.

When a golfer addresses a golf ball with an iron club, the topline of the clubhead and the leading edge of the clubhead define an angle which may be referred to as the projected topline angle, i.e., the angle which is projected onto the ground plane by the leading edge and the topline. The projected topline angle A is related to the topline angle B and the loft angle C by the expression:

$$A=\arctan(\tan B \sin C)$$

For a typical set of irons, the angle A varies from club to club within a set. Thus, a golfer must deal with a different geometric picture for each club, and that may affect the golfer's ability to align the club properly. Even if a golfer is instructed to align the clubhead by positioning the leading edge of the clubhead perpendicularly to the intended line of flight of the ball, I believe that many golfers subconsciously also use the topline of the clubhead to align the clubhead. This theory is supported by data which indicates that many golfers tend to pull the short irons, i.e., the more lofted irons, and tend to push the long irons, i.e., the less lofted irons.

Many golfers feel most comfortable with a mid-iron, e.g., a 5 iron. I believe that when some golfers change to a lower number club, they open the club to obtain the same visual image as the 5 iron. The result is a push or a fade. When they use a higher number club, they close the club and produce a pull or a hook.

SUMMARY OF THE INVENTION

The invention provides a set of golf clubs in which every club has the same projected topline angle. The topline angle of each club varies inversely with the loft angle so that the angle which a golfer sees, i.e., the projected topline angle, is the same for each club of the set.

DESCRIPTION OF THE DRAWING

The invention will be explained in conjunction with illustrative embodiments shown in the accompanying drawing, in which.

DESCRIPTION OF SPECIFIC EMBODIMENTS

Figure 1:
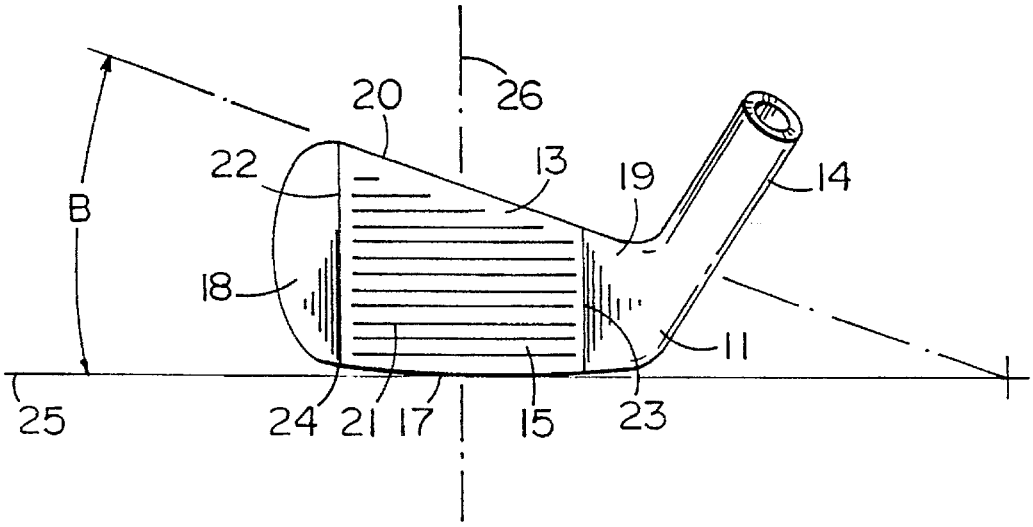
FIG. 1 is a front elevational view of an iron-type clubhead.
Figure 2:
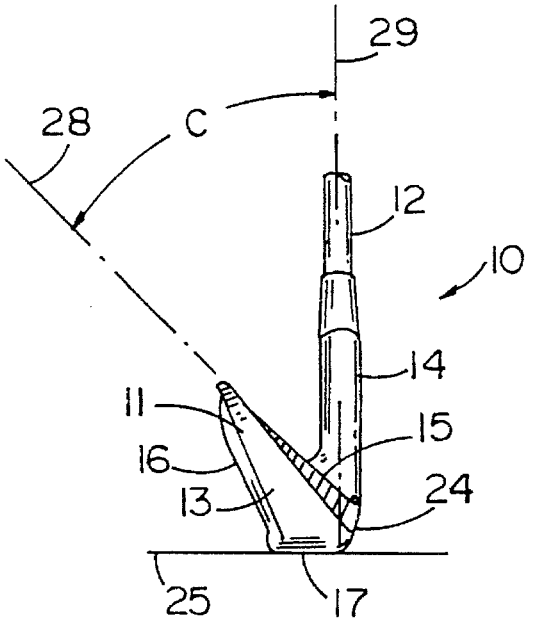
FIG. 2 is a toe end view of the clubhead of FIG. 1 which is equipped with a shaft.
Figure 3:
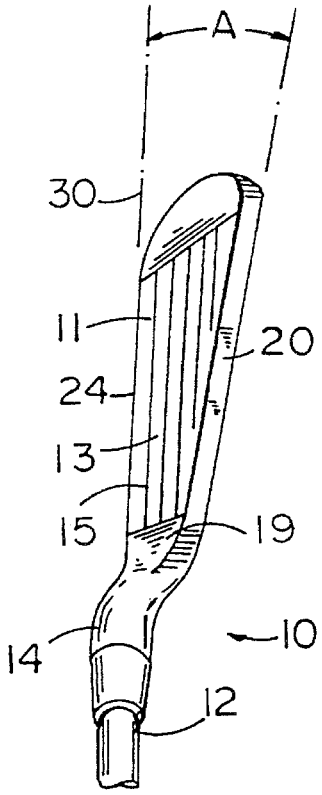
FIG. 3 is a view of the clubhead which a golfer sees when addressing a golf ball.

Referring to FIGS. 1–3 an iron-type golf club 10 includes a clubhead 11 and a shaft 12. The clubhead 11 includes a blade portion 13 and a hosel 14 for attaching the shaft to the clubhead. The blade 13 includes a front striking face 15, a rear surface 16, a bottom or sole 17, a toe 18, a heel 19, and a topline or edge 20. The face 15 is provided with conventional parallel grooves 21. The grooved area may be defined by perpendicular score lines 22 and 23 in the toe and heel areas. The face and the sole intersect at a leading edge 24 of the clubhead.

The topline angle B (FIG. 1) is defined by the topline 20 and a ground plane 25 which is tangent to the sole substantially in the center of the grooved area of the face. The ground plane is a well-understood term to golf club manufacturers and is used to define certain features such as topline angle and loft angle. However, the exact point of tangency of the ground plane with the sole might vary slightly from the center of the grooved area depending upon the design of the club. The ground plane extends perpendicularly to a midplane 26 which extends perpendicularly to the plane of the flat face 15 through the point of tangency between the ground plane and the sole. The grooves 21 extend parallel to the ground plane when the clubhead is properly soled on the ground.

When the topline angle B is measured, the face 15 is positioned so that it extends perpendicularly to the ground plane as illustrated in FIG. 1. If the topline is straight, the topline angle is defined by the topline or by an extension of the top line.

Figure 8:
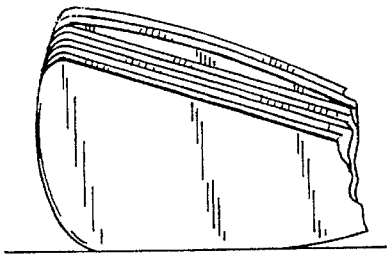
FIG. 8 (PRIOR ART)
FIG. 8 is a fragmentary view of aligned clubheads of another conventional set of clubheads, some of the clubheads having curved toplines.

The topline of some clubs is not straight. For example, FIG. 8 illustrates an aligned set of clubs in which the number 2 through 7 irons have straight toplines, and the number 8, 9, and PW irons have curved toplines. For a club which has a curved topline, the topline angle can arbitrarily be defined by the chord of the arc of the topline which extends between the intersections of the score line extremities 22 and 23 with the topline.

The loft angle C (FIG. 2) is the angle between the plane 28 of the flat face 15 and a vertical plane 29 which is aligned with the centerline of the shaft 12. The plane 29 is perpendicular to both the ground plane 25 and the midplane 27 and is parallel to a tangent to the leading edge at the midplane.

The projected topline angle A (FIG. 3) is the angle between the topline 20 and a tangent 30 to the leading edge 24 which extends perpendicularly to the midplane when viewed by a golfer who is addressing a golf ball with the club. Even though many golfers address a golf ball with the centerline of the shaft inclined toward the target, the projected topline angle is measured when the centerline of the shaft lies in the vertical plane 29 which is perpendicular to the ground plane 25. Measuring the projected topline angle in that manner provides a constant frame of reference which is not dependent on a particular golfer's address position. The projected topline angle is the angle which is projected onto the ground plane by the topline and the leading edge as viewed by the golfer.

If the topline is curved, then the projected topline angle is defined by the same chord which defines the topline angle.

Figure 7:
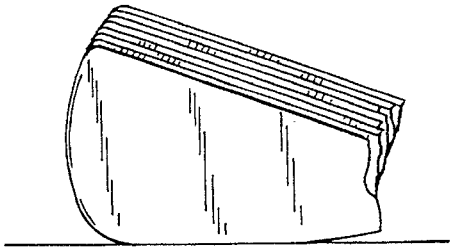
FIG. 7 (PRIOR ART)
FIG. 7 is a fragmentary view of aligned clubheads of a conventional set of clubheads numbered 2 through PW with straight toplines.

In most conventional sets of clubs, the topline angle B is constant or substantially constant for each club in the set, and the projected topline angle varies from club to club. FIG. 7 illustrates a conventional set of clubs from a 2 iron through PW which are aligned at the toes. The height of the toe and the topline increases as the number of the club increases, but the angle of the topline remains constant. The face of each club in FIG. 7 is perpendicular to the ground plane.

FIG. 8 illustrates a conventional set of clubs in which the 2 iron through 7 iron have straight toplines, and the 8 iron through PW have curved toplines. The face of each club in FIG. 8 is perpendicular to the ground plane.

Figure 4:
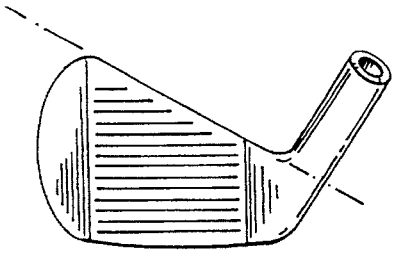
FIGS. 4–6 are views similar to FIG. 1 which illustrate different topline angles from steep to relatively flat.
Figure 5:
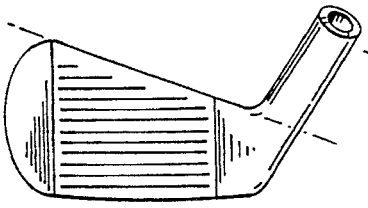
Figure 6:
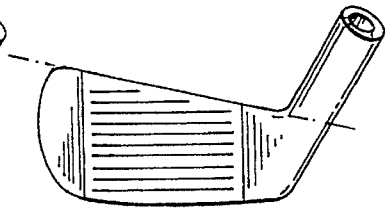

The topline angle can also vary from one set of clubs to another. FIGS. 4–6 illustrate a particular club, for example, a 5 iron, from three different sets. The set represented by FIG. 4 has a steep topline angle, the set represented by FIG. 5 has a conventional topline angle, and the set represented by FIG. 6 has a flat topline angle.

Table I illustrates how the projected topline angle varies from club to club for three prior art sets of clubs. One set has a constant topline angle of 14°, another set has a constant topline angle of 16°, and the third set has a constant topline angle of 18°.

TABLE I

GEOMETRIC CLUB BLADE PARAMETERS FOR PRIOR ART GOLF CLUB SETS

| | | top line angle | | |
|---|---|---|---|---|
| club # | loft angle | 14° | 16° | 18° |
| | | projected topline angle | | |
| 1 | 17° | 4° | 5° | 5° |
| 2 | 19° | 5° | 5° | 6° |
| 3 | 22° | 5° | 6° | 7° |
| 4 | 25° | 6° | 7° | 8° |
| 5 | 28° | 7° | 8° | 9° |
| 6 | 32° | 8° | 9° | 10° |
| 7 | 36° | 8° | 10° | 11° |
| 8 | 40° | 9° | 10° | 12° |
| 9 | 44° | 10° | 11° | 13° |
| PW | 48° | 10° | 12° | 14° |
| SW | 53° | 11° | 13° | 15° |
| TW | 58° | 12° | 14° | 15° |

In the first set, the projected topline angle, i.e., the angle which the golfer sees at address when the shaft is in the vertical plane 29 varies from 4° for the 1 iron to 12° for the TW (Tour Wedge or 58° wedge). In the second set, the projected topline angle varies from 5° to 14°. In the third set, the projected topline angle varies from 5° to 15°.

Table II lists the geometric parameters for three sets of clubs which are made in accordance with the invention. Each set of clubs has a constant projected topline angle. The first set has a constant projected topline angle of 6°, the second set has a constant projected topline angle of 8°, and the third set has a constant projected topline angle of 10°.

TABLE II

GEOMETRIC CLUB BLADE PARAMETERS FOR GOLF CLUB SETS WITH CONSTANT TOPLINE ANGLE

| | | projected top line angle | | |
|---|---|---|---|---|
| club # | loft angle | 6° | 8° | 10° |
| | | topline angle | | |
| 1 | 17° | 20° | 26° | 31° |
| 2 | 19° | 18° | 23° | 28° |
| 3 | 22° | 16° | 21° | 25° |
| 4 | 25° | 14° | 18° | 23° |
| 5 | 28° | 13° | 17° | 21° |
| 6 | 32° | 11° | 15° | 18° |
| 7 | 36° | 10° | 13° | 17° |
| 8 | 40° | 9° | 12° | 15° |
| 9 | 44° | 9° | 11° | 14° |
| PW | 48° | 8° | 11° | 13° |
| SW | 53° | 7° | 10° | 12° |
| TW | 58° | 7° | 9° | 12° |

In order to keep the projected topline angle of each set constant, the topline angle varies for each club. As the loft angle or the number of the club increases, the topline angle decreases. In the first set, which has a constant projected topline angle of 6°, the topline angle varies from 20° for a 1 iron to 7° for a TW. In the second set, which has a constant projected topline angle of 8°, the topline angle varies from 26° for a 1 iron to 9° for a TW. In the third set, which has a constant projected topline angle of 10°, the topline angle varies from 31° for a 1 iron to 12° for a TW.

The constant projected topline angles of 6°, 8°, and 10° are exemplary only. Sets of clubheads can be made with a constant projected topline angle different than those angles, for example, within a range of about 4° to 15°. Also, a set of clubs in accordance with the invention can include less than 12 clubs. For example, some standard sets include only the 3 iron through PW. Beginner sets sometimes include only odd number irons.

Table III lists geometric parameters for three sets of clubs which have curved toplines. The chord of the arc which extends between the vertical score lines 22 and 23 is used to define the projected topline angle. The data in each column is the difference between the height, i.e., the distance from the ground plane, of the toe at the score line 22 and the height of the heel at the score line 23. For a constant projected topline angle of 6°, the difference in height ranges from 0.81 inch for a 1 iron to 0.28 inch for a TW iron.

TABLE III

| | projected top line angle | | |
|---|---|---|---|
| club # | 6° | 8° | 10° |
| | difference between toe height and heel height inches | | |
| 1 | 0.81 | 1.08 | 1.36 |
| 2 | 0.73 | 0.97 | 1.22 |
| 3 | 0.63 | 0.84 | 1.06 |
| 4 | 0.56 | 0.75 | 0.94 |
| 5 | 0.50 | 0.67 | 0.85 |
| 6 | 0.45 | 0.60 | 0.75 |
| 7 | 0.40 | 0.54 | 0.67 |
| 8 | 0.37 | 0.49 | 0.62 |
| 9 | 0.34 | 0.46 | 0.57 |
| PW | 0.32 | 0.43 | 0.53 |
| SW | 0.30 | 0.40 | 0.50 |
| TW | 0.28 | 0.37 | 0.47 |

With clubs made in accordance with the invention, the topline of each club in the set presents the same image to the golfer at address. The golfer is therefore less likely to make mistakes in aligning the clubhead with the intended line of flight of the ball.

Figure 9:
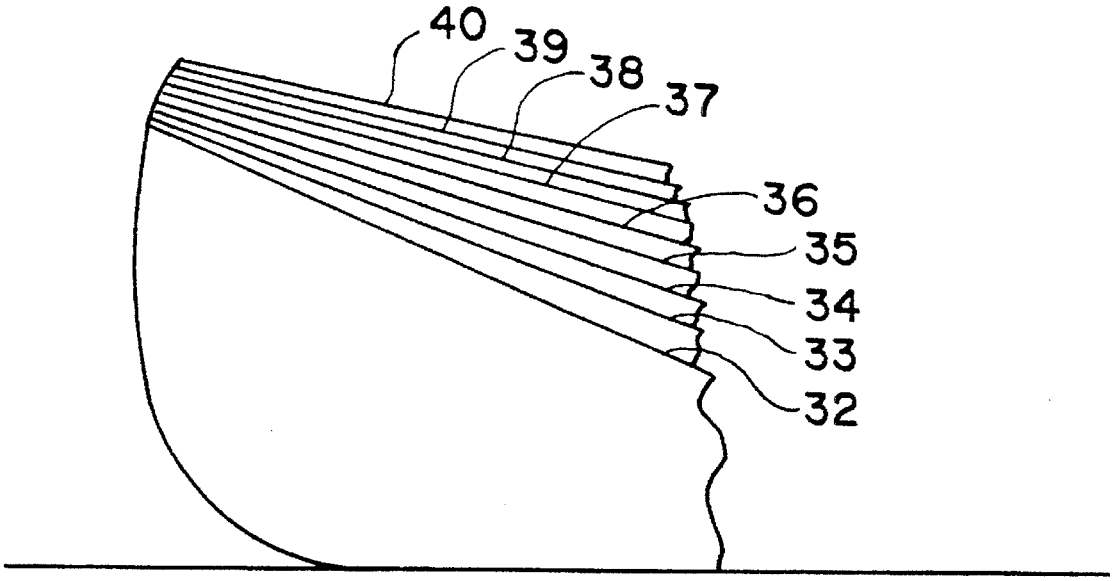
FIG. 9 is a fragmentary view of aligned clubheads of a set of clubheads numbered 2 through PW formed in accordance with the invention.

FIG. 9 illustrates a set of clubheads numbered 2 through PW which are formed in accordance with the invention. The 2 iron includes a topline 32, the 3 iron includes a topline 33, the 4 iron includes a topline 34, the 5 iron includes a topline 35, the 6 iron includes a topline 36, the 7 iron includes a topline 37, the 8 iron includes a topline 38, the 9 iron includes a topline 39, and the Pitching Wedge includes a topline 40.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A set of a plurality of golf clubs, each of the clubs including a clubhead and a shaft having a longitudinal centerline, each of the clubheads including a blade portion having a generally planar striking face and a hosel portion which is attached to the shaft, the blade portion including a sole having a bottom surface and a leading edge, the blade portion also having a topline, each clubhead having:

a loft angle which is defined by an angle between a plane of the striking face and a plane which extends through the centerline of the shaft and parallel to the leading edge of the sole, a topline angle which is defined by an angle between the topline of the blade portion and a ground plane which is tangent to the bottom surface of the sole, a projected topline angle which is defined by an angle between the topline and a plane which is tangent to the leading edge of the sole and parallel to said plane extending through the centerline of the shaft when viewed by a golfer who is addressing the club and who is generally aligned with said plane extending through the centerline of the shaft, the loft angle of each of the clubheads being different, the projected topline angle of each of the clubheads being greater than 0° and being substantially the same and the topline angle of each of the clubheads being different.

2. The set of golf clubs of claim 1 in which the projected topline angle of the clubhead is between about 4° and 15°.

3. The set of golf clubs of claim 1 in which the projected topline angle of the clubhead is between about 6° and 10°.

4. The set of golf clubs of claim 3 in which the topline angles of the clubheads are within the range of about 7° to 31°.

5. The set of golf clubs of claim 3 in which the topline angles of the clubheads vary inversely with the loft angles of the clubheads.

* * * * *